US006935308B1

(12) United States Patent
Nakamoto et al.

(10) Patent No.: US 6,935,308 B1
(45) Date of Patent: Aug. 30, 2005

(54) OPERATION CONTROL DEVICE OF MULTI-CYLINDER ENGINE

(75) Inventors: Katsuya Nakamoto, Tokyo (JP); Kohji Hashimoto, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/936,676

(22) Filed: Sep. 9, 2004

(30) Foreign Application Priority Data

Mar. 9, 2004 (JP) ..... 2004-066202

(51) Int. Cl.[7] ..... F02D 7/00
(52) U.S. Cl. ..... 123/395; 123/399
(58) Field of Search ..... 123/395, 399, 123/350, 352, 478, 480

(56) References Cited

U.S. PATENT DOCUMENTS 5,337,719 A * 8/1994 Togai ..... 123/478
6,192,311 B1 * 2/2001 Yasui et al. ..... 701/113
6,332,450 B1 * 12/2001 Muto et al. ..... 123/352

FOREIGN PATENT DOCUMENTS

JP 07-279698 A 10/1995
JP 2003-161194 A 6/2003
JP 2003-193889 A 7/2003

* cited by examiner

*Primary Examiner*—Mahmoud Gimie
(74) *Attorney, Agent, or Firm*—Sughrue Mion, PLLC

(57) ABSTRACT

An operation control device of a multi-cylinder engine having a long life and low power consumption is superior in acceleration/deceleration follow-up characteristic.

Individual cylinder intake pipes 15*a* to 15*d* of a multi-cylinder engine 10 controlled by an operation control device 30*a*, and provided with cylinders 10*a*, 10*b*, 10*c*, 10*d* are provided with throttle valves 21*a* to 21*d* of which valve openings are controlled by motors 20*a* to 20*d*.

The operation control device 30*a* including a microprocessor 31, a program memory 32*a*, and a data memory 33 performs an ON/OFF control of the motors 20*a* to 20*d* of individual cylinders in accordance with a corrective data stored in the data memory 33 for correcting an air intake resistance fluctuation in each individual cylinder intake pipe and a depression degree of an accelerator pedal.

10 Claims, 7 Drawing Sheets

FIG.. 3

OPERATION CONTROL DEVICE OF MULTI-CYLINDER ENGINE

BACKGROUND OF THE INVENTION

1. Field of the Invention

The present invention relates to an improvement of an operation control device of a multi-cylinder engine arranged to be capable of controlling an air-intake individually for each cylinder with respect to each cylinder intake pipe of an automobile multi-cylinder engine.

2. Description of the Related Art

An operation control device arranged to be capable of controlling an air-intake individually for each cylinder by disposing an intake control valve in an intake passage of each cylinder of a multi-cylinder engine and controlling a valve-opening time period of the foregoing intake control valve is well known.

For example, in the Japanese Patent Publication (unexamined) No. 279698/1995 (refer to FIGS. 1 and 2) titled "Internal Combustion Engine" as described above, an intake control valve is provided individually for each cylinder, and a throttle valve operating common to all the cylinders is also provided.

In the foregoing internal combustion engine, a total air-intake is suppressed with a throttle valve when an accelerator pedal is returned due to the fact that control of a small quantity of air intake control at the time of idling operation becomes difficult only by the control of an air intake time period alone using an intake control valve performing the operation of fully closing or opening the valve.

Further, in the Japanese Patent Publication (unexamined) No. 193889/2003 (refer to FIG. 1) titled "Air Intake Control Device of Multi-Cylinder Internal Combustion Engine", an intake control valve is provided in an intake passage of each cylinder, and an opening sensor acting to detect a valve opening of the intake control valve is also provided. Thus by controlling an intake valve opening, improvement in control of an idle engine speed is achieved such that any throttle valve common to all cylinders is not required.

On the other hand, in the Japanese Patent Publication (unexamined) No. 161194/2003 titled "Engine Control Device" relevant to the foregoing invention, the following detailed art is disclosed. This art relates, in the electronic throttle control electrically controlling a throttle valve opening, to an initial position return mechanism of a throttle valve drive mechanism, and to error determination means and non-defective determination means for an accelerator position sensor or a throttle position sensor that are displaced as a duplex system.

Both the above-mentioned Japanese Patent Publication (unexamined) No. 279698/1995 and the Japanese Patent Publication (unexamined) No. 193889/2003 adopt a type of controlling a valve-opening time period of the intake control valve. This type of intake control valve has to perform opening or closing the intake control valve at a high speed every air intake process of each cylinder. Hence a problem exits in that a large amount of power consumption of the drive control circuit is required and much deterioration of the opening/closing operation mechanism is induced, eventually resulting in a larger-sized and more expensive device to ensure a control life.

Moreover, in the above-mentioned Japanese Patent Publication (examined) No. 161194/2003, one throttle valve is provided with respect to all cylinders of a multi-cylinder engine to control a total quantity of air-intake. Therefore, a distance between the throttle valve and the intake valves of each cylinder comes to be long resulting in another problem of reduction in response of acceleration or deceleration of the engine.

SUMMARY OF THE INVENTION

The present invention was made to solve the above-discussed problems, and has a first object of providing an operation control device of a multi-cylinder engine including electronic throttle control means, fuel injection control means, and air/fuel ratio control means, the operation control device of a multi-cylinder engine possessing long life, low power consumption, and superior acceleration/deceleration follow-up characteristic.

A second object of the invention is to provide an operation control device capable of correcting a cylinder difference based on variety of an air intake piping, and enhancing an overall efficiency of the multi-cylinder engine.

A further object of the invention is to provide an operation control device capable of maintaining an appropriate air/fuel ratio, and decreasing a poisonous exhaust gas even in the sate that a different quantity of air intake is carried out individually for each cylinder.

To accomplish the foregoing objects, an operation control device of a multi-cylinder engine according to the present invention includes electronic throttle control means, fuel injection control means, and air/fuel ratio control means. The mentioned electronic throttle control means includes motors each provided at an individual cylinder intake pipe to control a throttle valve opening; and a drive control circuit feeding an electric power to the mentioned motor includes a switching element of which ON/OFF is controlled by a microprocessor having a program memory and a data memory. The mentioned data memory contains a corrective characteristic parameter; and the mentioned program memory contains a program acting as means for setting a target throttle valve opening that can be obtained by adding a characteristic correction value or multiplying a characteristic correction coefficient with reference to a detection output from an accelerator position sensor detecting a depression degree of an accelerator pedal, and a program acting as motor control means.

The mentioned corrective characteristic parameter is a statistical data that can be obtained by actually measuring preliminarily a relation between throttle valve openings of individual cylinders with which each individual cylinder air-intake becomes uniform in accordance with a detection output from an airflow sensor that is provided at an intake manifold located in upstream position of the mentioned individual cylinder intake pipe. The mentioned corrective characteristic parameter acts as a characteristic parameter to compensate fluctuation in air intake resistance of an intake pipe. The mentioned characteristic correction value or characteristic correction coefficient is an addition/subtraction constant or a multiplication coefficient correcting a target throttle valve opening individually for each cylinder so as to control a throttle valve opening of each individual cylinder based on the mentioned corrective characteristic parameter.

In addition, the mentioned motor control means is means for controlling ON/OFF of the mentioned switching element individually to cylinders so that a detection output from a throttle position sensor for each individual cylinder that detects a throttle valve opening becomes equal to the mentioned target throttle valve opening having been corrected individually for each cylinder.

As described above, in the operation control device of a multi-cylinder engine according to this invention, a throttle valve opening of an individual cylinder intake pipe is electrically controlled in response to a depression degree of the accelerator pedal, and fuel injection is performed individually for each cylinder so as to be capable of obtaining a predetermined air/fuel ratio. As a result, a piping distance between a throttle valve and a cylinder is shortened, thereby advantageously enabling to enhance an acceleration/deceleration of the engine. Further, a throttle valve opening only needs to be held at a constant value in the sate of stable traveling, so that an advantage is obtained such that a power consumption of an electric control mechanism is decreased, and that deterioration of a switching mechanism of a throttle valve is reduced.

Further, such a valve-opening drive control that makes an air-intake of every cylinder uniform is carried out individually with a corrective characteristic parameter, so that a cylinder difference due to piping of intake pipe is corrected. In consequence, an advantage is obtained such that there is no reduction in efficiency as a whole, and that piping design of an intake pipe becomes easier.

Furthermore, an airflow sensor is located in an integrated manner at the intake manifold where there is not much air intake pulsation, so that an advantage of measuring a total air-intake at a reasonable cost and with high accuracy is obtained.

Moreover, the mentioned corrective characteristic parameter is stored in a data memory based on a statistical data provided by in-vehicle test working, so that advantageously it is possible to achieve a high degree of freedom in design, and to obtain an accurate corrective characteristic parameter based on an actually measured data.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiment 1

(1) Detailed Description of Construction of Embodiment 1

Figure 1:
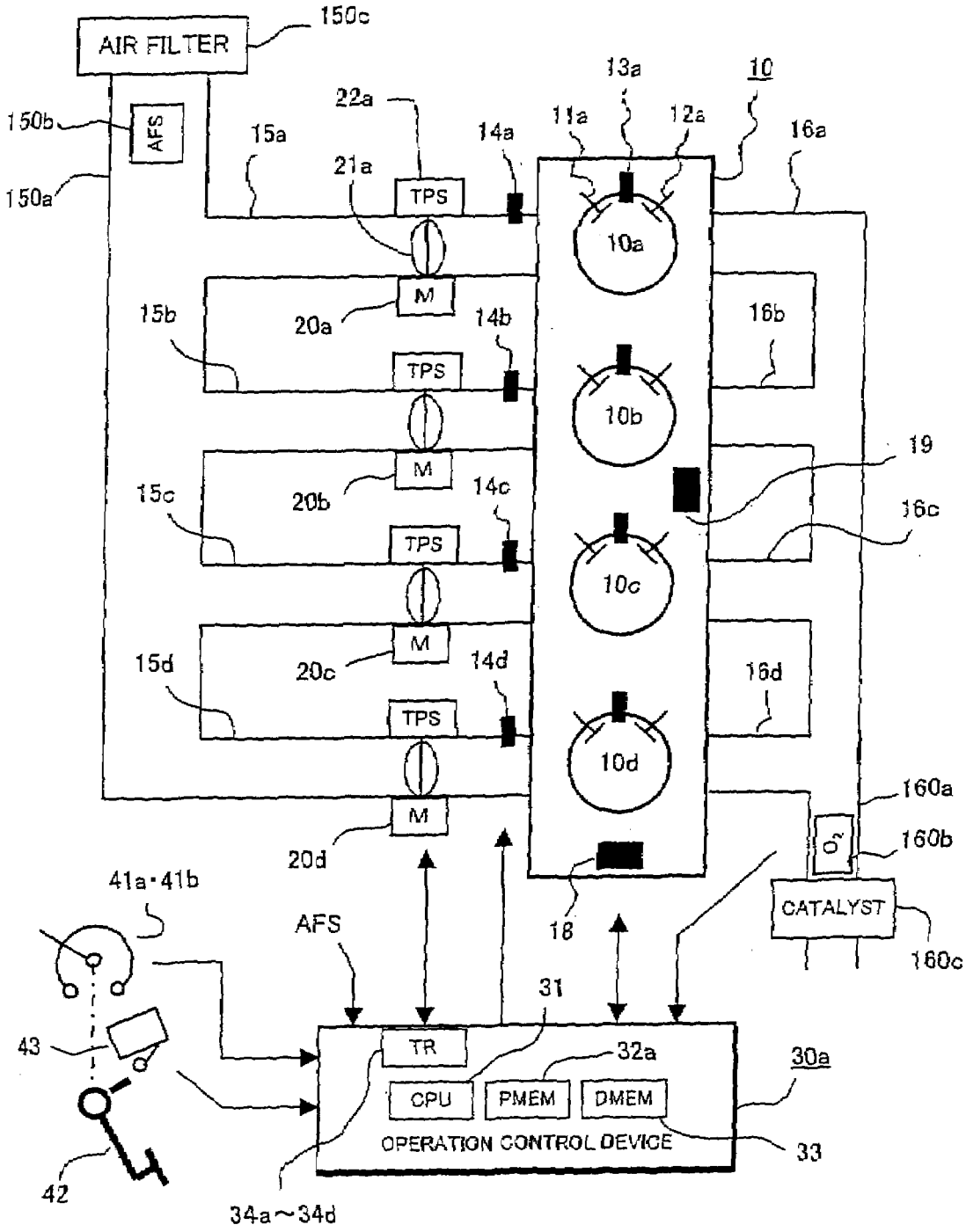
FIG. 1 is a block diagram showing an overall mechanism of an operation control device according to a first preferred embodiment of the present invention.

With reference to FIG. 1 showing an entire mechanism diagram of an operation control device according to a first embodiment of the present invention is hereinafter described.

Referring to FIG. 1, a multi-cylinder engine 10 is shown as a four-cylinder engine including cylinders 10*a*, 10*b*, 10*c*, 10*d*, and each of the cylinders 10*a*–10*d* is provided with intake valves 11*a*–11*d* and exhaust valves 12*a*–12*d* respectively cooperating with the rotation of crankshafts (not shown) In the case where the multi-cylinder engine 10 is a gasoline engine, ignition plagues 13*a*–13*d* are used.

Fuel injecting solenoid valves 14*a*–14*d* are provided in the vicinity of an inlet of the intake valves 11*a*–11*d*. Individual cylinder intake pipes 15*a*–15*d* in communication with the intake valves 11*a*–11*d* form an intake passage leading to outside air via an intake manifold 150*a*, an airflow sensor 150*a*, and an air filter 150*a*.

Individual cylinder exhaust pipes 16*a* to 16*f* in communication with the exhaust valves 12*a* to 12*d* form an exhaust passage leading to outside air via an exhaust manifold 160*a*, and exhaust gas sensor 160*a*, and an exhaust gas purification catalyst 160*c*.

Motors 20*a* to 20*d* drive opening/closing throttle valves 21*a*–21*d* to control the increase and decrease of an air-intake passing through the individual cylinder intake pipes 15*a* to 15*d*. An opening of the throttle valves 21*a* to 21*d* is detected by throttle position sensors 22*a* to 22*d*.

In addition, fuel injecting solenoid valves 14*a* to 14*d* are disposed between the throttle valves 21*a* to 21*d* and the intake valves 11*a* to 11*d*; and the airflow sensor 150*b* or the exhaust gas sensor 160*b* is disposed within the intake manifold 150*a* or the exhaust manifold 160*a* respectively. This arrangement allows detection of a total air-intake with respect to all the cylinders 10*a* to 10*d*, or an oxygen concentration of a total exhaust gas.

A crank angle sensor 18 is provided at the crankshaft (not shown). With this crank angle sensor 18, fuel injection timing or ignition timing is determined, and an output therefrom is used as a signal for use in calculation of an engine speed.

A coolant temperature sensor 19 measures a coolant temperature of the engine, which is used for steadily maintaining an idle engine speed of the engine.

An operation control device 30*a* is mainly made up of a microprocessor 31. This microprocessor 31 executes an ON/OFF control of switching elements 34*a* to 34*d* in cooperation with a program memory 32*a* or a data memory 33 that is a non-volatile memory such as flash memory to control the power feed of the motors 20*a* to 20*d* so that an opening of the throttle valves 21*a* to 21*d* is a target opening of each individual cylinder.

Additionally, input signals of a pair of accelerator position sensors 41*a* and 41*b* mounted as a duplex system in order to detect a depression degree of an accelerator pedal 42, or those of an idle switch 43 operating at the return position of the accelerator pedal 42 are connected to the operation control device 30*a*. In this manner, an opening of the throttle valves 21*a* to 21*d* are controlled so as to increase or decrease in response to a depression degree of the accelerator pedal 42.

The microprocessor 31 controls an open time period of the fuel injecting solenoid valves 14*a* to 14*d* based on a total air intake that is detected by the airflow sensor 150*b* and an exhaust oxygen concentration signal that is detected by the exhaust gas sensor 160*b* to adjust fuel to be supplied to each individual cylinder, thereby maintaining an appropriate air-fuel ratio (i.e., ratio between air weight and fuel weight).

Figure 2:
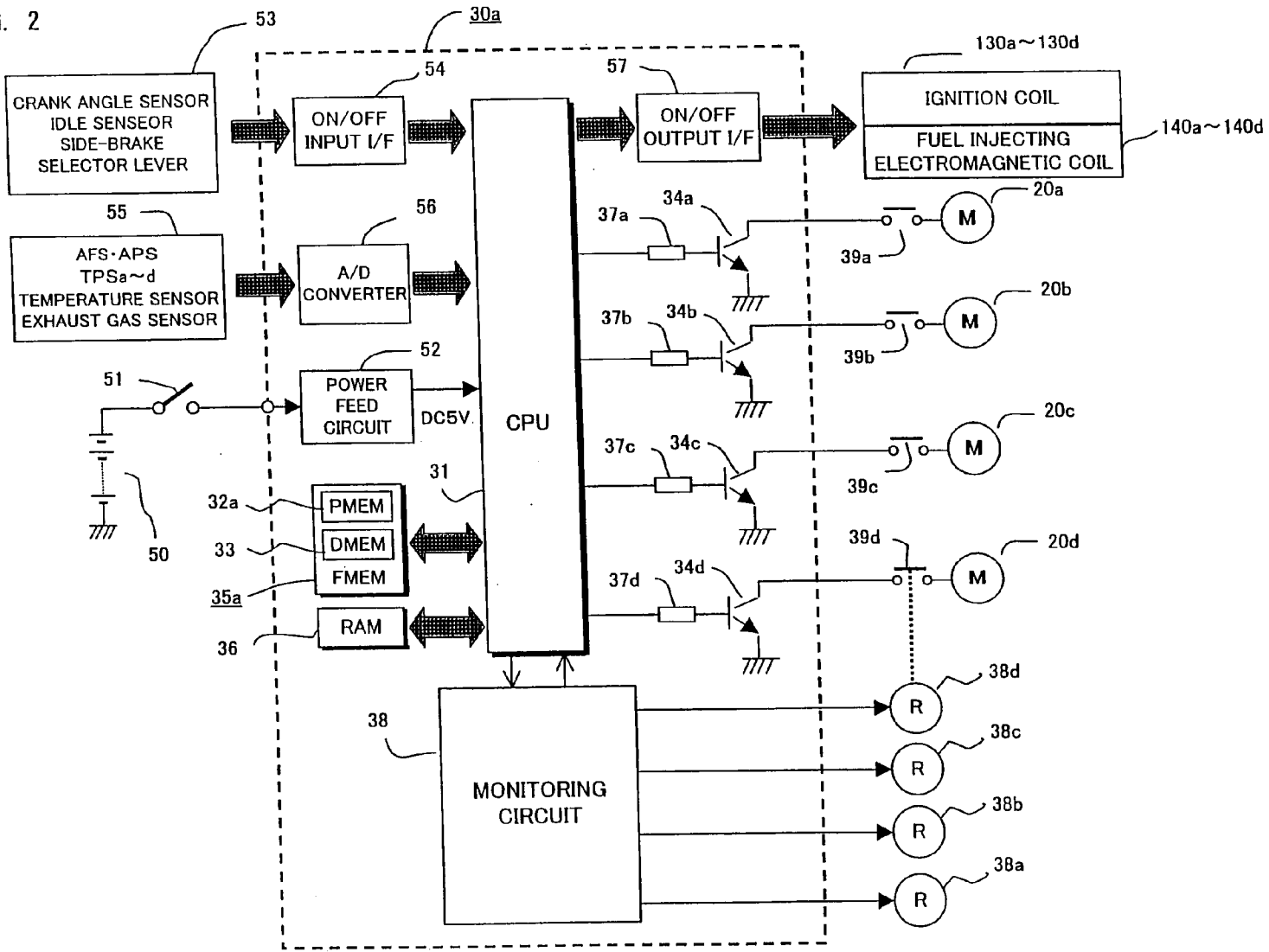
FIG. 2 is an entire control block diagram of the operation control device shown in FIG. 1.

With reference to FIG. 2 being a block diagram of the overall control of the operation control device shown in FIG. 1, the microprocessor 31 forming an operation control device 30*a* is provided with a non-volatile flash memory 35*a* containing a program memory region 32*a* and a data memory region 33, and a RAM memory 36 for the operation processing, in order to execute the ON/OFF control of the switching elements 34*a* to 34*d* via drive resistors 37*a* to 37*d*.

In addition, the switching elements 34*a* to 34*d* actually drive rotation in normal direction or in reverse direction of the motors 20*a* to 20*d* with four transistors forming respective H-type bridge circuits.

A monitoring circuit 38 associative with the microprocessor 31 energizes load power supply relays 38*a* to 38*d* in a normal state to close a circuit of output contacts 39*a* to 39*d* that are provided between the switching elements 34*a* to 34*d* and the motors 20*a* to 20*d*.

However, in case of the occurrence of disconnection and short circuit error of a power supply circuit with respect to the motors 20*a* to 20*d*, or the occurrence of disconnection and short circuit error of a detection circuit of the above-described throttle position sensors 22*a* to 22*d*, a load power supply relay 38*a* to 38*d* of a system where the error occurs is de-energized, and a power supply circuit of a motor 20*a* to 20*d* to which an output contact 39*a* to 39*d* of the load power supply relay having been de-energized is interrupted.

In addition, the operation control device 30*a* is fed with power via a power supply switch 51 from an on-vehicle battery 50, and operates with a stable voltage of DC 5V applied from a constant voltage power supply circuit 52.

Further, an input sensor group 53 performing the ON/OFF operation such as the above-described crank angle sensor 18 and idle switch 43, or a side-brake switch, selector switch (not shown) is bus-connected to the microprocessor 31 via an input interface 54.

Likewise, an analog input sensor group 55 such as the above-described airflow sensor 150*b*, accelerator position sensors 41*a* and 41*b*, throttle position sensors 22*a* to 22*d*, coolant temperature sensor 19, exhaust gas sensor 160*b* is digital-converted via a multi-channel AD converter 56, and thereafter bus-connected to the microprocessor 31.

Ignition coils 130*a* to 130*d* applying a high voltage to the above-described ignition plagues 13*a* to 13*d* or electromagnetic coils 140*a* to 140*d* driving the fuel injecting solenoid valves 14*a* to 14*d* are bus-connected to the microprocessor 31 via an output interface 57 that is formed of a latch memory and a power transistor.

Figure 3:
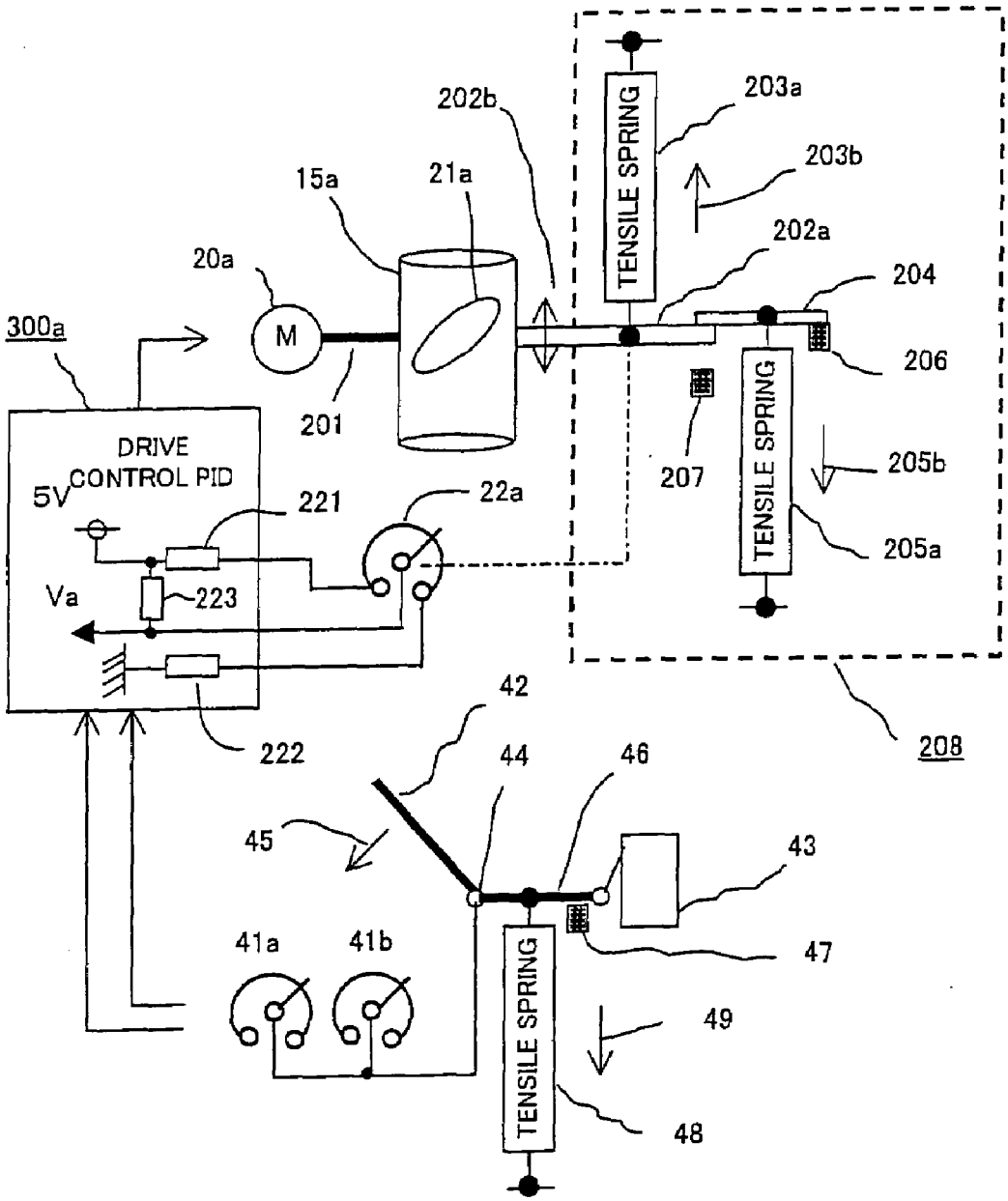
FIG. 3 is an initial position return mechanism diagram of the operation control device shown in FIG. 1.

With reference to FIG. 3, being an initial position return mechanism diagram of the operation control device shown in FIG. 1, the throttle valve 21*a* within each individual cylinder intake pipe 15*a* performs the valve-opening angle operation with a rotary shaft 201 of the motor 20*a*, there by a direct-coupled oscillating part ~202*a* comes to cooperate therewith. For reasons of description, the foregoing oscillating part is represented to perform a vertical motion in a direction indicated by the arrow 202*b*.

The direct-coupled oscillating part 202*a* receives an impetus in a direction indicated by the arrow 203*b* (in the valve-opening direction) from a tensile spring 203*a*. However, a return member 204 that receives an impetus in a direction indicated by the arrow 205*b* (in the valve-closing direction) from a tensile spring 205*a* causes the direct-coupled oscillating part 202*a* to return in the valve-closing direction against the force provided by the tensile spring 203*a*. The return position of the direct-coupled oscillating part is regulated with a default stopper 206.

When the return member 204 drives the direct-coupled oscillating part 202*a* further in the valve-closing direction from the state of having returned to the position of the default stopper 206, the direct-coupled oscillating part 202*a* performs the valve-closing operation until the direct-coupled oscillating part 202*a* comes in contact with a idle stopper 207.

Accordingly, the motor 20*a* controls an valve opening against the force provided the tensile spring 203*a* in a range from the default stopper 206 to the idle stopper 207, and further performs the valve-opening control against the force provided by the tensile spring 205*a* under the cooperation with the tensile spring 203*a* as to the valve-opening operation beyond the default stopper 206.

Further, upon interruption of a power supply of the motor 20*a*, the direct-coupled oscillating part 202*a* performs the valve-closing operation or valve-opening operation up to the position regulated with the default stopper 206 by the action of tensile springs 205*a* and 203*a*. This position is the valve opening position in case of evacuation operation at the time of error.

Furthermore, a throttle position sensor 22*a* is located so as to detect an operation position of the direct-coupled oscillating part 202*a* that is a valve opening of a throttle. In addition, an initial position return mechanism 208 is constituted of the tensile springs 203*a*, 205*a*, the direct-coupled oscillating part 202*a*, the return member 204, the default stopper 206 and the like. The motors 20*b* to 20*d* are constituted in the same manner.

As the motors 20*a* to 20*d*, e.g., a DC motor, brushless motor, stepping motor are employed. In this embodiment, a DC motor that is controlled at an ON/OFF ratio is used, and the control thereof is executed by a drive control circuit 300*a* within the operation control device 30*a*.

As the throttle position sensor 22*a*, a potentiometer that is fed with an electric power from a DC 5V power supply within the drive control circuit 300*a* via positive-negative dropper resistors 221 and 222 is employed, and a detection signal Va is obtained from a rotatable-slidable terminal to which a pull-up resistor 223 is connected. Throttle position sensors 22*b* to 22*d* are arranged in the same manner.

An accelerator pedal 42 is depressed in a direction indicated by the arrow 45 with a fulcrum 44 being center. A connection member 46 receives an impetus in a direction indicated by the arrow 49 from a tensile spring 48, and drives the accelerator pedal 42 in the return direction.

The return position of the accelerator pedal 42 is regulated with a pedal stopper 47. Further, an idle switch 43 detects the fact that the accelerator pedal 42 is not depressed and has returned to the position regulated with the pedal stopper 47.

A pair of accelerator position sensors 41*a* and 41*b* that are mounted as duplex system are located so as to detect a depression degree of the accelerator pedal 42. This pair of accelerator position sensors 41*a* and 41*b* includes positive-negative dropper resistors (not shown) in the same manner as the throttle position sensor 22*a*, and a pull-down resistor (not shown) is connected to a slidable terminal thereof.

In addition, a positive-negative dropper resistor, pull-up resistor, or pull-down resistor, which are provided at the throttle position sensor 22*a* or the accelerator position sensors 41*a* and 41*b*, acts to detect the disconnection and short circuit error of a sensor circuit or to obtain a detection output on the safety side at the time of disconnection error. In case of any detection output being out of range of 0.5 to 4.5V, the disconnection and short circuit error is determined.

In the case where both of the accelerator position sensors 41*a* and 41*b* are in the state of disconnection and short circuit error, or detection outputs therefrom are in non-coincidence despite that both of the accelerator positions sensors 41*a* and 41*b* are not in the disconnection and short circuit error, the accelerator position sensors are determined to be in error. Further, when at least either of them is not in the state of disconnection and short circuit, a detection output therefrom is used.

Figure 4:
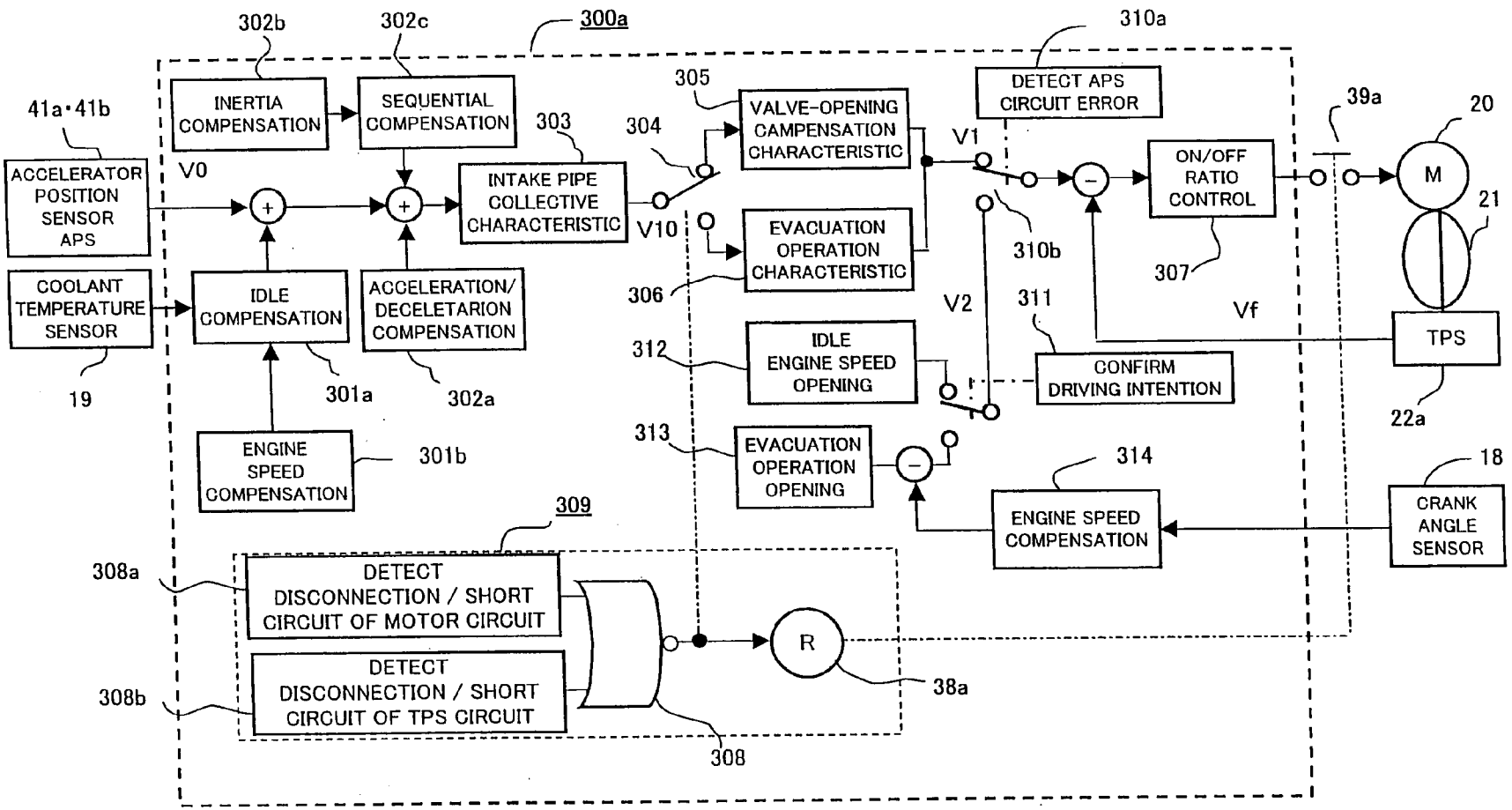
FIG. 4 is a block diagram showing details of a drive control circuit shown in FIG. 3.

Now, a detailed block diagram of the drive control circuit 300*a* of FIG. 3 is shown in FIG. 4. With reference to FIG. 4, to the drive control circuit 300*a* with respect to the motor 20*a* controlling a valve opening of the throttle valve 21*a*, a detection signal of either of a pair of accelerator position sensors 41*a* and 41*b* of which detection outputs are in coincidence is inputted as a reference target throttle valve opening signal V0. In addition, a detection output from the throttle position sensor 22*a* is inputted as a feedback signal Vf.

An idle rotation compensation output 301*a* generates an addition compensation output so as to make a throttle valve opening larger when an engine temperature detected by a coolant temperature sensor 19 is low. Likewise the idle rotation compensation output 301*a* generates an addition compensation output so as to make a throttle valve opening larger with engine speed compensation means 301*b* when the minimum engine speed of each individual cylinder that is measured with an operation time interval of a crank angle sensor 18 is low.

An acceleration/deceleration compensation output 302*a* is a compensation output that makes a throttle valve opening of a cylinder having a high air intake responsibility smaller than that of a cylinder having a low air intake responsibility, or causes a throttle valve opening of a cylinder having a high air intake response to reach in a delayed manner the mentioned reference value corresponding to a detection output from the accelerator position sensors 41*a* and 41*b*, based on a desired acceleration/deceleration that is detected with a differential value of detection outputs from the accelerator position sensors 41*a* and 41*b* and a difference in air intake response of the individual cylinder intake pipes 15*a* to 15*b*.

Additionally, even if an intake pipe of a larger diameter and length and an intake pipe of a smaller diameter and length have a statically identical air intake resistance, they show a transiently different response characteristic, and fluctuation in air intake response occurs. Therefore, the acceleration/deceleration compensation output serves to compensate the foregoing difference or fluctuation individually for each cylinder to obtain the same transient characteristic.

An inertia compensation output 302*b* is a compensation output that operates in response to a desired acceleration/deceleration detected with a differential value of detection outputs from the accelerator position sensors 41*a* and 41*b* to increase or decrease in common a target throttle valve opening of each cylinder.

Sequential compensation means 302*c* acts when a target throttle valve opening changes, and causes a target throttle valve opening with respect to a throttle valve of a cylinder at which an air intake process starts to sequentially change, thereby improving an air intake response.

For example, supposing that a valve opening of the throttle valves 21*a* to 21*d* is made larger all at once when the accelerator pedal 42 is depressed sharply, intake passages between the throttle valves 21*a* to 21*d* and the intake valves 11*a* to 11*d* are also refilled with an atmospheric air, eventually resulting in the delay of air intake with respect to the cylinders under the process of air intake. However, for example, by making a valve opening of the throttle valve 21*a* larger preferentially when a cylinder A having an intake valve 11*a* is in the air intake process, it becomes possible to rapidly perform the air intake with respect to the targeted cylinder A without non-urgent air refilling as mentioned above.

A corrective control block 303 is a control block that compensates fluctuation in air intake resistance of an intake pipe based on a corrective characteristic parameter to be obtained by actually measuring preliminarily such a relation between throttle valve openings of individual cylinders as to make each individual cylinder air-intake uniform, corresponding to a detection output from the airflow sensor 150*b* provided at the intake manifold 150*a* in the upstream position of the individual cylinder intake pipes 15*a* to 15*d* and to an engine speed. Through this corrective control block 303, a corrective target throttle valve opening signal V10 can be obtained.

A compensation control block 305 that becomes effective when the later-described evacuation operation switching means 304 is inoperative is a control block for compensating a target throttle valve opening of individual cylinders so as to control a throttle valve opening of each individual cylinder one by one based on a valve-opening characteristic parameter that determines a characteristic of an appropriate throttle valve opening of each individual cylinder having been actually measured preliminarily in order to obtain an efficient engine output as a whole in accordance with a depression degree of the accelerator pedal and an engine speed.

In addition, the above-mentioned valve-opening characteristic parameter is determined such that operation is carried out in a full-throttle state with a throttle valve of all cylinders full open under the state that the accelerator pedal is fully depressed. The operation is carried out with the cylinders divided into a first cylinder group of which throttle valve opening becomes a little larger than a standard value and a second cylinder group of which throttle valve opening becomes a little smaller under the state that the accelerator pedal is depressed halfway. The fuel injection relative to the above-mentioned first cylinder group and the fuel injection relative to the above-mentioned second cylinder group are performed alternately. In this process, an increase/decrease deviation from the above-mentioned standard value is suppressed within a range that a vehicle body vibration does not become actual.

An evacuation control block 306 that becomes effective when the later-described evacuation operation switching means 304 operates is a control block that determines a throttle valve opening of a normal cylinder, corresponding to the number of cylinders being in the state of fixed throttle valve opening, a depression degree of the accelerator pedal and an engine speed, and based on an evacuation characteristic parameter that can be obtained by actually measuring preliminarily a relation between appropriate throttle valve openings of the remaining normal cylinders. A PID control block 307 controls an ON/OFF ratio of the switching element 34*a* so that a value of a signal voltage proportional to a target throttle valve opening V1, being an output from the compensation control block 305 or the evacuation control block 306, and a feedback signal voltage Vf proportional to a detection output from the throttle position sensor 221 corresponding to an actual throttle valve opening are in coincidence. An NOR block 308 de-energizes a load power supply relay 38*a* with NOR output from a disconnection and short circuit detection output 308*a* of a drive circuit of the motor 20*a* and a disconnection and short circuit detection output 308*b* of the throttle position sensor 22*a*, and brings an output contact 39*a* in an open circuit to stop the power feed to the motor 20*a*.

When error processing means 309 comprised of the NOR block 308, the disconnection and short circuit detection outputs 308*a* and 308*b*, and the load power supply relay 38*a* operates, the above-described evacuation operation switching means 304 comes to operate.

Alternative target throttle valve opening selection means 310*b* is means that operates in response to sensor circuit error detection means 310*a* brought in operation when both of the accelerator position sensors 41*a* and 41*b* mounted as a duplex system are in the disconnection and short circuit error, or when detection outputs therefrom are in non-coincidence although both sensors 41*a* and 41*b* are not in the disconnection and short circuit error. The alternative target throttle valve opening selection means 310*b* selects and switches a target throttle valve opening of each cylinder to an alternative target throttle valve opening V2 irrespective of a depression degree of the accelerator pedal.

Driving intention confirmation means 311 is switching means that monitors operation of any of idle switch 43 operating in response to the fact that the accelerator pedal has completely returned, a side-brake switch operating in response to the fact that an auxiliary brake for stopping and holding a vehicle operates, or a select switch operating when a gearshift lever is switched to a neutral position or parking position, in order to determine whether or not there is an intention to move a vehicle forward or backward, and selects a first alternative target throttle valve opening 312 or a second alternative target throttle valve opening 313.

The first alternative target throttle valve opening 312 is the minimum target throttle valve opening that operates when the driving intension confirmation means 311 determines the absence of driving intension to obtain an idle engines speed corresponding to a steady minimum engine speed. The second alternative target throttle valve opening 313 operates when the driving intension confirmation means 311 determines the presence of driving intension, and is an evacuation operation target throttle valve opening larger than the above-mentioned minimum target throttle valve opening.

Engine rotation suppression means 314 is set speed suppression means that operates when an engine speed to be calculated by measuring an operation frequency of the crank angel sensor 18 comes close to and exceeds a predetermined threshold regulated at the time of evacuation operation, and decreases a value of an alternative target throttle valve opening V2 based on the second alternative target throttle valve opening 313.

Controls of the motors 20*b* to 20*d* are carried out in the same manner. A reference target throttle valve opening signal V0 or an inertia compensation output 302*b*, the second alternative target throttle valve opening 313 and engine rotation suppression means 314, alternative target throttle valve opening selection means 310*b*, and driving intention confirmation means 311 are of a common control content in each motor.

Figure 5:
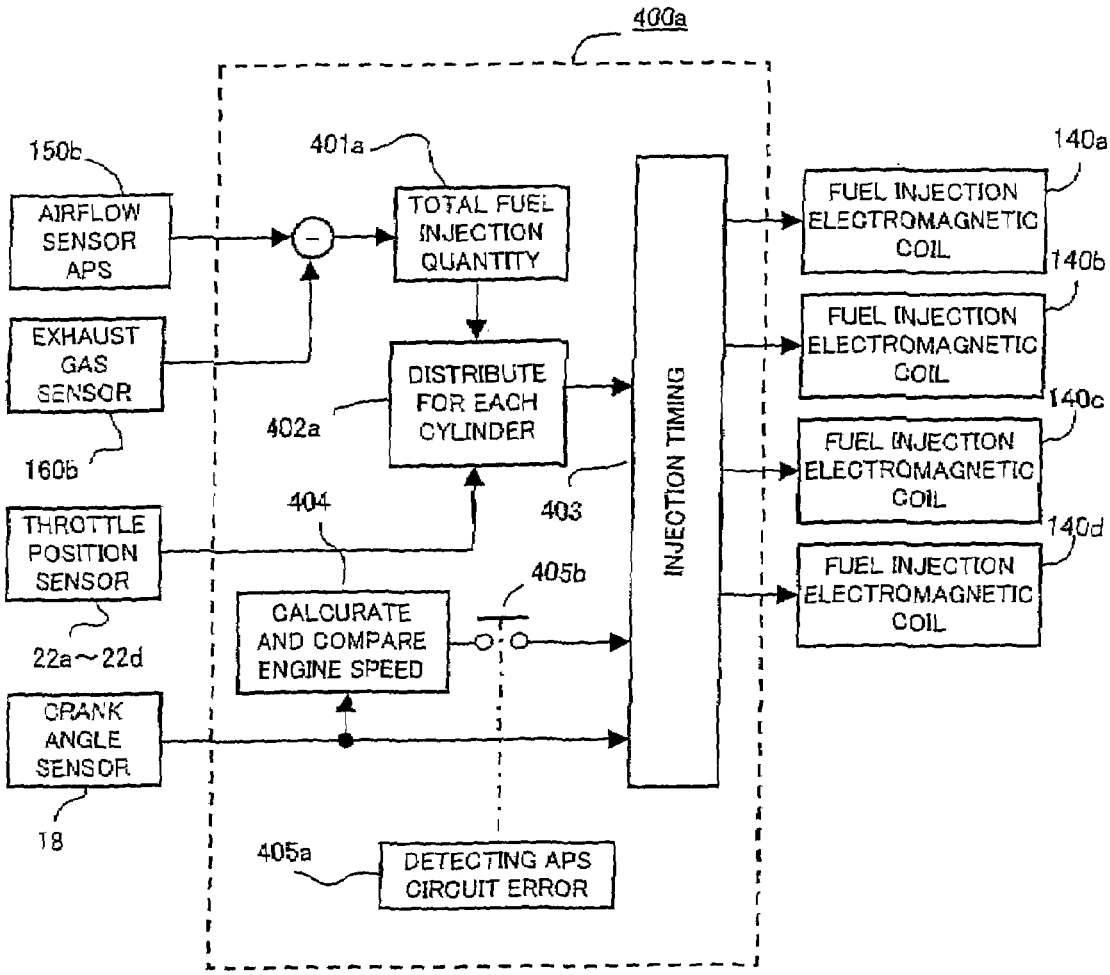
FIG. 5 is a block diagram of fuel injection control means of the operation control device shown in FIG. 1.

A detailed block diagram of the fuel injection control means 400*a* is shown in FIG. 5. With reference to FIG. 5, control signals such as those of the airflow sensor 150*b*, the exhaust gas sensor 160*b*, the throttle position sensors 22*a* to 22*d*, and the crank angle sensor 18 are inputted to fuel injection control means 400*a* with respect to electromagnetic coils 140*a* to 140*d* of the fuel injecting solenoid valves 14*a* to 14*d*.

Total air/fuel ratio control means 401*a* is means that determines such a total fuel feed quantity as to obtain a predetermined air/fuel ratio in accordance with a total air intake detected by the airflow sensor 150*a*, adjusts a total fuel feed quantity with a detection output from the exhaust gas sensor 160*b*, and executes a feedback compensation so as to be capable of obtaining a predetermined air/fuel ratio.

Individual cylinder fuel injection distributing means 402*a* is means that distributes a quantity of the above-mentioned total fuel feed into individual cylinder fuel injection quantities in accordance with a detection output from the throttle position sensors 22*a* to 22*d* of the individual cylinders. Fuel injection timing control means 403 controls drive start timing and drive period of the fuel injecting solenoid valves 14*a* to 14*d* of the individual cylinders, and the foregoing drive period is determined based on a distribution quantity of the above-mentioned individual cylinder fuel injection.

Sensor circuit error detection means 405*a* brings an error output contact 405*b* in operation when both of the accelerator position sensors 41*a* and 41*b* mounted as a duplex system are in the disconnection and short circuit error, or detection outputs therefrom are in non-coincidence despite that both of the accelerator position sensors 41*a* and 41*b* are not in the disconnection and short circuit error. Engine rotation suppression means 404 is fuel cut means that stops the fuel injection when an engine speed that is calculated by measuring an operation frequency of the crank angle sensor 18 exceeds a predetermined threshold regulated at the time of evacuation.

In addition, in the case where not less than three accelerator position sensors are mounted as a multiplex system, the sensors can be determined to be in error when all the accelerator position sensors mounted as a multiplex system are in the disconnection and short circuit error, or detection outputs therefrom are in non-coincidence despite that all the accelerator position sensors are not in the disconnection and short circuit error.

(2) Detailed Description of Action and Operation of Embodiment 1

In the operation control device according to the first embodiment of the invention arranged as shown in FIGS. 1 to 5, action and operation of each diagram is now described.

With reference to FIGS. 1 and 2, the operation control device 30*a* with respect to the multi-cylinder engine 10 generates a control output, the microprocessor 31 in cooperation with the program memory 32*a* and the data memory 33 acting as a main component, drives the motors 20*a* to 20*d* controlling a valve opening of the throttle valves 21*a* to 21*d* that are provided at the individual cylinder intake pipes 15*a* to 15*d*. Further, the operation control device 30*a* energizes the electromagnetic coils 140*a* to 140*d* of the fuel injecting solenoid valves 14*a* to 14*d* and controls a fuel injection timing and period individually for each cylinder thereby controlling a fuel injection quantity for each individual cylinder. A reference value of a target throttle valve opening is determined in proportion to a detection output from the accelerator position sensors 41*a* and 41*b* mounted as a duplex system for the purpose of detecting a depression degree of the accelerator pedal 42. In addition, a total fuel feed quantity is adjusted so as to maintain a predetermined air/fuel ratio, taking a detection output from the airflow sensor 150*b* provided at the intake manifold 150*a* as a reference, and utilizing a detection output from the exhaust gas sensor 160*b* provided at the exhaust manifold 160*a*.

A total fuel feed quantity having been adjusted in such a manner is distributed into throttle valve openings of individual cylinders detected by the throttle position sensors 22*a* to 22*d* to determine a fuel injection quantity of each individual cylinder, thus a fuel injection period corresponding to a determined fuel injection quantity comes to be determined.

When the monitoring circuit 38 detects the disconnection and short circuit error of the throttle position sensors 22*a* to 22*d*, or detects the disconnection and short circuit error of a drive circuit of the motors 20*a* to 20*d*, the load power supply relays 38*a* to 38*d* are de-energized, and the output contacts 39*a* to 39*d* are brought in an open circuit, resulting in interruption of the power feed circuit to the motors 20*a* to 20*d*.

When the power feed to the motors 20*a* to 20*d* is interrupted, the throttle valves 21*a* to 21*d* are returned to a predetermined initial position by the initial position return mechanism 208 shown in FIG. 3.

In addition, it is preferable to generate an interlock signal interrupting the switching elements 34*a* to 34*d* instead of the load power supply relays 38*a* to 38*d*.

With reference to FIG. 4 showing a detailed block arrangement of the motor control, an idle compensation output 301*a*, an acceleration/deceleration compensation output 302*a* or an inertia compensation output 302*b* is added to a reference target throttle valve opening signal V0, being a value proportional to a detection output from the accelerator position sensor 41*a* or 41*b*, and a corrective target throttle valve opening signal V10 is obtained through the corrective control block 303.

A corrective target throttle valve opening signal V10 acts to correct a difference in air intake resistance or air intake response of each cylinder to cause the air-intake of each cylinder to be in coincidence by making target values of respective cylinders different.

On the contrary, the compensation control block 305 that is applied at the time of normal operation when error processing means 309 operating in response to a disconnection and short circuit output 308*a* of the motor circuit and a disconnection and short circuit detection output 308*b* of the throttle position sensor circuit is in an inoperative state, causes an air-intake of each cylinder to change, and outputs a target throttle valve opening signal V1 for each individual cylinder in order to suppress a fuel consumption for a total output of the engine.

Further, the evacuation control block 306 that is applied at the time of error operation when error processing means 309 operates, remains mixed with a cylinder operated at a fixed throttle valve opening to be determined by the initial position return mechanism 208 and outputs a target throttle valve opening signal V1 for each of the remaining individual cylinder capable of performing the normal operation.

When sensor error detection means 310*a* as to the accelerator position sensors 41*a* and 41*b* detects any error, an alternative target throttle valve opening signal V2 is selected by alternative target throttle valve opening selection means 310*b*.

When driving intention confirmation means determines the absence of driving intention by monitoring that accelerator pedal 42 has returned to operate the idle switch 43, that a side-brake switch operates to detect an operation state of the stopping-holding auxiliary brake of a vehicle or that a selector switch operates to detect the neutral or parking state of a selector lever of gearbox, then a throttle valve opening at which an idle engine speed can be obtained is selected with the first alternative target throttle valve opening 312. When the presence of driving intention is determined, the second alternative target throttle valve opening 313, being a value larger than the first alternative target throttle valve opening 312 is selected.

A vehicle speed at the time of driving at a valve opening to be determined with the second alternative target throttle valve opening 313 changes depending on a vehicle weight or road gradient, so that adjustment of vehicle velocity is carried out by varying a depression degree of the brake pedal.

However, to prevent an engine speed from being too large, a throttle valve opening is suppressed by engine rotation suppression means 314.

With reference to FIG. 5 showing fuel injection control means in detail, in this first embodiment, a total fuel feed quantity is adjusted in accordance with a detection output from the airflow sensor 150*b* detecting a total air-intake and a detection output from the exhaust gas sensor 160*b* mounted on the exhaust manifold 160*a*, and controlled so as to be at a predetermined air/fuel ratio. Further, a fuel injection quantity for each individual cylinder is distributed depending on a detection output from the throttle position sensors 22*a* to 22*d*.

In actual operation, however, a fuel injection quantity of individual cylinders is determined by distributing into assumed air-intake for each individual cylinder based on a corrective characteristic parameter for compensating fluctuation in air intake resistance of intake pipes. Further, in addition to the engine rotation suppression means 314 shown in FIG. 4, engine rotation suppression means 404 employing the method of fuel cut shown in FIG. 5 is used in combination.

In addition, although one throttle position sensor is used with respect to each throttle valve, a throttle position sensor can be located as a duplex system.

Furthermore, in the case where a return position of a throttle valve when the power feed circuit to the motor is interrupted is not a predetermined return position, it is preferable to add such means as to compensate a control characteristic of the evacuation control block 306 with a detection output from the throttle position sensor of the throttle valve having returned abnormally.

(3) Description of Features and Advantages of Embodiment 1

As has been obvious with the above-mentioned descriptions, an operation control device according to the first embodiment of the invention including an operation control device 30*a* of a multi-cylinder engine 10 comprising electronic throttle control means, fuel injection control means, and air/fuel ratio control means. In this operation control device, the mentioned electronic throttle control means includes motors 20*a* 20*d* for controlling a throttle valve opening that is provided respectively at individual cylinder intake pipes 15*a* 15*d*; and a drive control circuit feeding an electric power to mentioned motor includes switching elements 34*a* to 34*d* of which ON/OFF is controlled by a microprocessor 31 having a program memory 32*a* and a data memory 33.

The mentioned data memory further contains a corrective characteristic parameter 303; and the mentioned program memory 32*a* further contains a program acting as means for setting a target throttle valve opening that can be obtained by adding a characteristic correction value or multiplying a characteristic correction coefficient taking a detection output from accelerator position sensors 41*a* and 41*b* detecting a depression degree of an accelerator pedal 42 as a reference, and a program acting as motor control means.

The mentioned corrective characteristic parameter 303 is a statistical data that can be obtained by actually measuring preliminarily a relation between throttle valve openings of individual cylinders with which an individual cylinder air-intake becomes uniform, in accordance with a detection output from an airflow sensor 150*b* that is provided at an intake manifold 150*a* located in an upstream position of the mentioned individual cylinder intake pipes 15*a* to 15*d*, and is a characteristic parameter to compensate fluctuation in air intake resistance of an intake pipe.

The mentioned characteristic correction value or characteristic correction coefficient is an addition/subtraction constant or a multiplication coefficient correcting a target throttle valve opening individually for each cylinder so as to control a throttle valve opening of each individual cylinder based on the mentioned corrective characteristic parameter.

The mentioned motor control means is means that controls ON/OFF of the mentioned switching elements 34*a* to 34*d* for each individual cylinder so that a detection output from throttle position sensors 22*a* to 22*d* for each individual cylinder detecting a throttle valve opening becomes equal to the mentioned target throttle valve opening having been corrected individually for each cylinder; and in which a throttle valve opening of the individual cylinder intake pipes 15*a* to 15*d* is electrically controlled depending on a depression degree of the accelerator pedal 42, and fuel injection is performed individually for each cylinder so as to be capable of obtaining a predetermined air/fuel ratio.

Additionally, in the case of a 6-cylinder engine, for example, it is preferable to arrange as follows. That is, an entire intake manifold in which an air filter is provided is bifurcated into first and second intake manifolds; and the first intake manifold leads to a first group of cylinder intake valves A, B, C via each individual cylinder intake pipe, and the second intake manifold leas to a second group of cylinder intake valves D, E, F via each individual cylinder intake pipe. In such an arrangement, the airflow sensor may be located, being divided into the mentioned first and second intake manifolds respectively.

It is preferable that a fuel injection solenoid valve is not disposed between the individual cylinder throttle valves 21*a* to 21*d* and the intake valves 11*a* to 11*d*, but disposed within each of the cylinders 10*a* to 10*d* so as to perform a direct high-pressure injection.

The mentioned program memory 32*a* further contains a program acting as means for setting a target throttle valve opening that can be obtained by adding an idle rotation compensation output 301*a* taking the mentioned detection output from the accelerator position sensors 41*a* and 41*b* as a reference. The mentioned idle rotation compensation output 301*a* operates in an idle rotation state that an accelerator pedal 42 is not depressed and is a compensation output that increases or decreases in accordance with a deviation between a steady minimum engine speed relevant to a coolant temperature of an engine and a current engine speed. The mentioned motor control means is means that controls ON/OFF of the mentioned switching elements 34*a* to 34*d* individually for each cylinder so that a detection output from throttle position sensors 22*a* to 22*d* of the individual cylinders that detect a throttle valve opening becomes equal to the mentioned target throttle valve opening having been corrected.

As a result, a feature exists in that a cylinder difference in idle rotation is corrected with the idle rotation compensation output 301*a*, and pulsation of an idle engine speed is reduced, thereby enabling to obtain a more steady low-speed idle engine speed.

The mentioned program memory 32*a* further contains a program acting as means for setting a target throttle valve opening that can be obtained by adding an acceleration/deceleration compensation output 302*a* taking a detection output from accelerator position sensors 41*a* and 41*b* detecting a depression degree of an accelerator pedal 42 as a reference, and a program acting as motor control means.

The mentioned acceleration/deceleration compensation output 302*a* is a compensation output that transiently makes a throttle valve opening of a cylinder having a high response characteristic smaller than a cylinder having a low response characteristic, or causes a throttle valve opening of a cylinder having a high response characteristic to reach, in a delayed manner, the mentioned reference value corresponding to a detection output from the accelerator position sensors 41*a* and 41*b* based on a desired acceleration/deceleration detected with a differential value of the mentioned detection outputs from the accelerator position sensors 41*a* and 41*b* and a difference in transient response characteristic of individual cylinder intake pipes 15*a* to 15*d*.

The mentioned motor control means is means that performs an ON/OFF control of the mentioned switching elements 34*a* to 34*d* individually for each cylinder so that a detection output from throttle position sensors 22*a* to 22*d* of the individual cylinders that detect a throttle valve opening becomes equal to the mentioned target throttle valve opening having been compensated. In this motor control means, a throttle valve opening of individual cylinder intake pipes 15*a* to 15*d* is electrically controlled in response to a depression degree of the accelerator pedal 42, and fuel injection is performed individually for each cylinder so as to be capable of obtaining a predetermined air/fuel ratio.

As a result, a throttle valve opening of individual cylinder intake pipes 15*a* to 15*d* is electrically controlled in response to a depression degree of the accelerator pedal 42, and fuel injection is performed individually for each cylinder so as to be capable of obtaining a predetermined air/fuel ratio, whereby a piping distance between the throttle valves 21*a* to 21*d* and cylinders is shortened, thus enabling to enhance an acceleration/deceleration of the engine. Further, in the sate of stable traveling, a throttle valve opening only needs to be held at a constant value, thus a feature exits in that a power consumption of an electric control mechanism is decreased, and that deterioration of a switching mechanism of the throttle valves 21*a* to 21*d* is reduced.

Furthermore, the uniform acceleration/deceleration can be carried out with an acceleration/deceleration compensation output even if there is a difference in air intake piping characteristic of each cylinder, thus a cylinder difference due to piping construction of an intake pipe is corrected. In consequence, a feature exists in that efficiency as a whole is not reduced, while piping design of an intake pipe becomes easier.

The mentioned program memory 32*a* further contains a program acting as means for setting a target throttle valve opening that can be obtained by adding an inertia compensation output 302*b* taking the mentioned detection output from the accelerator position sensors 41*a* to 41*d* as a reference. The mentioned inertia compensation output 302*b* is a compensation output that increases or decreases in common a target throttle valve opening of each cylinder in response to a desired acceleration/deceleration detected with a differential value of the mentioned detection output from the accelerator position sensors 41*a* to 41*d*. The mentioned motor control means is means that controls ON/OFF of the mentioned switching elements 34*a* to 34*d* individually for each cylinder so that a detection output from the throttle position sensors 22*a* to 22*d* of the individual cylinders detecting a throttle valve opening comes to be equal to the mentioned target throttle valve opening having been compensated.

As a result, the acceleration/deceleration can be enhanced further with the inertia compensation output 302*b* so that there is a feature that influence upon a driving performance can be reduced even if a vehicle body weight increases.

The mentioned program memory 32*a* further contains a program acting as means for setting a target throttle valve opening that can be obtained taking a detection output from the accelerator position sensors 41*a* and 41*b* detecting a depression degree of an accelerator pedal 42 as a reference, a program acting as motor control means, and a program acting as sequential compensation means. The mentioned sequential compensation means is means that operates when the mentioned target throttle valve opening changes and causes a target throttle valve opening with respect to a throttle valve of a cylinder at which an air intake process starts to sequentially change. The mentioned motor control means is means that controls ON/OFF of the mentioned switching elements 34*a* 34*d* individually for each cylinder so that a detection output from throttle position sensors 22*a* to 22*d* of the individual cylinders detecting a throttle valve opening comes to be equal to mentioned target throttle valve opening having been compensated. As a result, a feature exists in that a non-urgent inflow and outflow of atmosphere to an intake passage between the throttle valves 21*a* to 21*d* and the intake valves 11*a* to 11*d* is decreased, so that an air intake response is improved. A further feature and advantages exists in that the motor control may be carried out sequentially, so that the control burden of the microprocessor is reduced. Furthermore, there are also features and advantages of preventing the increase in wiring diameter of a power supply system, suppressing the increase in rating current of a power supply fuse, suppressing the increase in copper foil pattern width of an electronic board of the operation control device 30*a*, preventing the increase in drive noise, preventing the capacity increase in noise countermeasure capacitor of the operation control device 30*a*, and the like.

The mentioned data memory 33 further contains a valve-opening characteristic parameter 305. The mentioned program memory 32*a* further contains a program acting as means for setting a target throttle valve opening that can be obtained by adding a characteristic compensation value or multiplying a characteristic compensation coefficient taking a detection output from the accelerator position sensor detecting a depression degree of an accelerator pedal 42 as a reference, and a program acting as motor control means.

The mentioned valve-opening characteristic parameter 305 is a statistical data determining a characteristic of an appropriate throttle valve opening of individual cylinders having been actually measured preliminarily in order to obtain an efficient engine output as a whole in accordance with a depression degree of the accelerator pedal 42 and an engine speed. The mentioned characteristic compensation value or characteristic compensation coefficient is an addition-subtraction constant or a multiplication coefficient to compensate a target throttle valve opening of individual cylinders so as to control a throttle valve opening for each individual cylinder based on the mentioned valve-opening characteristic parameter 305.

The mentioned motor control means is means that controls ON/OFF of the mentioned switching elements 34*a* to 34*d* individually for each cylinder so that a detection output from throttle position sensors 22*a* to 22*d* of the individual cylinders detecting a throttle valve opening comes to be equal to the mentioned target throttle valve opening of individual cylinders. A throttle valve opening of individual cylinder intake pipes 15*a* to 15*d* is electrically controlled depending on a depression degree of the accelerator pedal 42, and fuel injection is carried out individually for each cylinder so as to be capable of obtaining a predetermined air/fuel ratio.

As a result, a feature exists in that a throttle valve opening of the individual cylinder intake pipes 15*a* to 15*d* is electrically controlled depending on a depression degree of the accelerator pedal 42, and fuel injection is carried out individually for each cylinder so as to be capable of obtaining a predetermined air/fuel ratio, thus a piping distance between the throttle valves 21*a* to 21*d* and the cylinders is shortened thereby enabling to enhance acceleration/deceleration of the engine. Further, a throttle valve opening only needs to be held at a constant value in the sate of stable traveling, so that a further feature and advantage exits in that a power consumption of an electric control mechanism is decreased, and that deterioration in switching mechanism of the throttle valves 21*a* to 21*d* is reduced. Furthermore, a throttle valve opening of the cylinders is controlled for each individual cylinder with an valve-opening characteristic parameter 305, thereby enabling to improve an overall efficiency.

In addition, an engine efficiency that is a ratio between an output P of an engine at a certain engine speed N (KW) and a fuel consumption ratio being a fuel consumption per hour unit comes to be the maximum at an optimum throttle valve opening $\theta 0$.

Itis to be noted that there is a state that a fuel consumption ratio is reduced in the case of the same total engine output on the driving conditions that taking a total engine output when a throttle valve opening of all cylinders is $\theta$ ($<\theta 0$) at an engine speed N (rpm) as a reference, a throttle valve opening of a first cylinder group and a throttle valve opening of a second cylinder group are intentionally made unequal such as letting the former $\theta 1$ and the latter $\theta 2$, and $\theta 2$ ($>\theta 1$) is caused to be close to a throttle valve opening $\theta 0$ of the maximum efficiency. The mentioned valve-opening characteristic parameter 305, being such an efficiency improvement characteristic data is stored in the data memory 33 based on a statistical data by the method of in-vehicle test drive. As a result, a feature exits in that a high degree of freedom is achieved in the development process, and a more precise valve-opening characteristic parameter can be obtained than based on a theoretical value.

The mentioned valve-opening characteristic parameter 305 is determined such that drive operation is carried out in a full-throttle state with throttle valves 21*a* to 21*d* of all cylinders full open under the condition that the accelerator pedal 42 is fully depressed; the drive operation is carried out with the cylinders divided into a first cylinder group of which throttle valve opening becomes a little larger than a standard value and a second cylinder group of which throttle valve opening becomes a little smaller under the condition that the accelerator pedal 42 is depressed halfway; the fuel injection relative to the mentioned first cylinder group and the fuel injection relative to the mentioned second cylinder group are performed alternately; and, at the same time, an increase/decrease deviation from the mentioned standard value is suppressed within a range where a car body vibration does not become actual.

As a result, since the operation is performed with cylinders divided into the first and second cylinder group, which makes the occurrence of un-uniform car body vibration less likely to suppress a throttle valve opening difference of each cylinder group, a feature exits in that a car body vibration can be reduced as compared with a type of performing a variable cylinder operation by stopping the operation of a cylinder.

A mechanism section of the mentioned electronic throttle control means includes an initial position return mechanism 208, the mentioned data memory further contains an evacuation characteristic parameter 306, and the mentioned program memory further contains a program acting as error processing means 309 and evacuation operation switching means 304. The mentioned initial position return mechanism 208 is a mechanism operating upon interruption of a current to the mentioned motor to return and set a throttle valve opening of individual cylinder intake pipes 15*a* to 15*d* to a fixed position. The mentioned error processing means 309 is means that operates when detecting a disconnection and short circuit at a motor power feed circuit and a disconnection and short circuit with respect to a detection circuit of throttle position sensors 22*a* to 22*d*, and interrupts the power supply for the motors 22*a* to 22*d* or the switching elements 34*a* to 34*d* of the motor mounted on the cylinder where error occurs.

Furthermore, the mentioned evacuation characteristic parameter 306 is a statistical data that can be obtained by actually measuring preliminarily a relation between appropriate throttle valve openings of the remaining normal cylinders, in accordance with the number of cylinders in the fixed throttle valve opening state, a depression degree of the accelerator pedal 42, and an engine speed. The mentioned evacuation operation switching means 304 is means that performs selection and switches so as to control a throttle valve opening of a normal cylinder based on the mentioned evacuation characteristic parameter in a non-control state that the mentioned error processing means 309 operates and a throttle valve opening of a part of cylinders is initialized by the mentioned initial position return means 208. As a result, a feature exists in that, even if the control function of any throttle valve of a specified cylinder is lost, a throttle valve opening of the cylinder in error is made to return to a predetermined initial value, and a throttle valve of the remaining normal cylinders is controlled, thereby enabling the evacuation operation of high quality.

The mentioned program memory 32*a* further contains a program acting as alternative target throttle valve opening selection means 310*b*, driving intention confirmation means 311, first and second alternative target throttle valve opening setting means 312 and 313, and engine rotation suppression means 314. The mentioned alternative target throttle valve opening selection means 310*b* is means that operates when all the accelerator position sensors 41*a* and 41*b* located as a multiplex system are in the disconnection and short circuit error, or detection outputs in coincidence cannot be obtained despite that the accelerator position sensors 41*a* and 41*b* are not in the disconnection and short circuit error, and selects a first or second alternative target throttle valve opening 312 or 313 irrelevant to a depression degree of the accelerator pedal 42 to be a target throttle valve opening of each cylinder. The mentioned driving intention confirmation means 311 is means that monitors operation of any of an idle switch 43 operating responsive to the fact that the accelerator pedal 42 has fully returned, a side brake switch that operates responsive to the fact that an auxiliary brake for stopping and holding a vehicle operates, or a select switch that operates when a gear shift lever is switched to be in a neutral position or parking position, thereby determining whether an intention to move a vehicle forward or backward is present or absent.

Further, the mentioned first alternative target throttle valve opening 312 is a minimum target throttle valve opening, which operates when the mentioned driving intention confirmation means 311 determines the absence of driving intention, and at which an idle engine speed corresponding to a steady minimum engine speed is obtained. The mentioned second alternative target throttle valve opening 313 is an evacuation operation target throttle valve opening, which operates when the mentioned driving intention confirmation means 311 determines the presence of driving intention, and which is a valve opening larger than mentioned minimum target throttle valve opening.

The mentioned engine rotation suppression means is fuel cut means 404 that stops the operation of a fuel injection solenoid valve when an engine speed in operation at the mentioned second alternative target throttle valve opening 313 exceeds a predetermined threshold to interrupt fuel supply, or set speed suppression means 314 that decreases by degrees and compensates the mentioned second alternative throttle valve opening 313 as an engine speed rises. As a result, a feature exists in that in the state that a target throttle valve opening cannot be set due to error of the accelerator position sensors 41*a* and 41*b*, the evacuation operation can be performed with an alternative throttle valve opening, and a vehicle speed can be adjusted by the operation of a brake pedal.

The mentioned program memory 32*a* contains a program acting as total air/fuel ratio adjustment means 401*a*, individual cylinder fuel injection distributing means 402*a*, and fuel injection timing control means 403. The mentioned total air/fuel ratio adjustment means 401*a* is means that adjusts a total fuel feed quantity to all cylinders so as to get a predetermined air/fuel ratio in accordance with a detection output from an airflow sensor 150*b* provided at the mentioned intake manifold 150*a* and a detection output from an exhaust gas sensor 160*b* provided at an exhaust manifold 160*a*. The mentioned individual cylinder fuel injection distributing means 402*a* is means that distributes the mentioned total fuel feed quantity into individual cylinder fuel injection quantities depending on the mentioned detection output from the throttle position sensors 22*a* to 22*d* of the individual cylinders. The mentioned fuel injection timing control means 403 is means that controls a drive start timing and a drive period of fuel injection solenoid valves 14*a* to 14*d* of each cylinder, the mentioned drive period being determined based on a distribution quantity of the mentioned individual cylinder fuel injection.

As a result, a feature exists in that even if a throttle valve opening of each cylinder is different, a total fuel feed quantity of the whole cylinders is controlled with the use of one exhaust gas sensor 160*b* provided at the exhaust manifold 160*a*, thereby enabling to control an air/fuel ratio of each cylinder to be a practically appropriate value.

Embodiment 2

Figure 6:
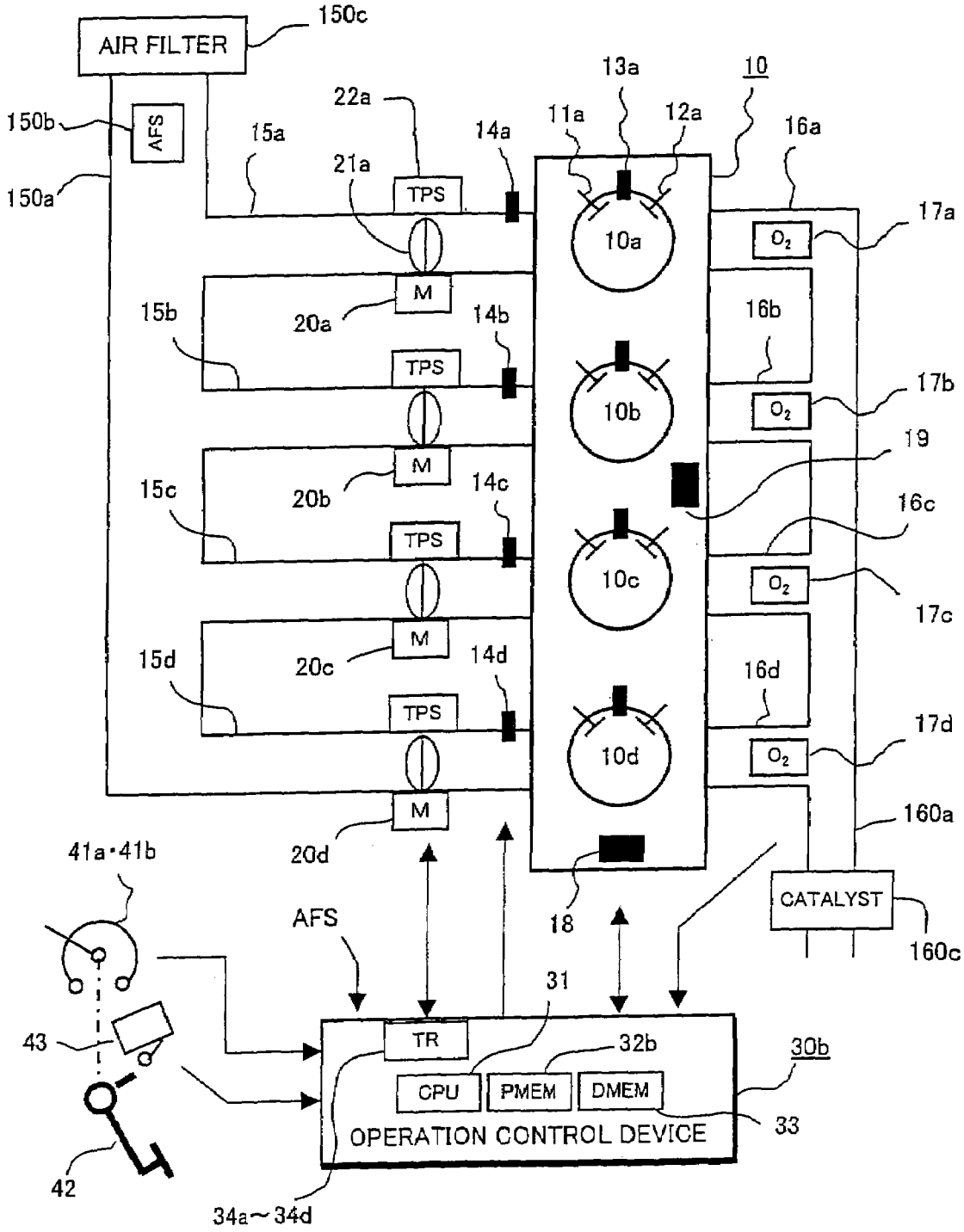
FIG. 6 is an entire mechanism diagram of an operation control device according to a second embodiment of the invention.

With reference to FIG. 6, an entire mechanism diagram of an operation control device according to a second preferred embodiment of the invention is hereinafter described explaining mainly differences from that shown in FIG. 1.

Referring now to FIG. 6, an operation control device 30*b* controlling a multi-cylinder engine 10 includes a microprocessor 31 having a program memory 32*b* and a data memory 33 as a main component. This operation control device 30*b* drives the motors 20*a* to 20*d* in response to a detection output from the accelerator position sensors 41*a* and 41*b* that detects a depression degree of the accelerator pedal 42, controls a valve opening of the throttle valves 21*a* to 21*d* provided at individual cylinder intake pipes 15*a* to 15*d*, and controls an operation timing and period of the fuel injection valves 14*a* to 14*d* in accordance with a total air-intake detected at the airflow sensor 150*b* provided at the intake manifold 150*a*. Further, in the operation control device 30*b* according to this second embodiment, exhaust gas sensors 17*a* to 17*d* that performs a feedback control of an air/fuel ratio are located at individual cylinder exhaust pipes 16*a* to 16*d*, and not at the exhaust manifold 160*a*. This is different from the operation control device of FIG. 1.

Figure 7:
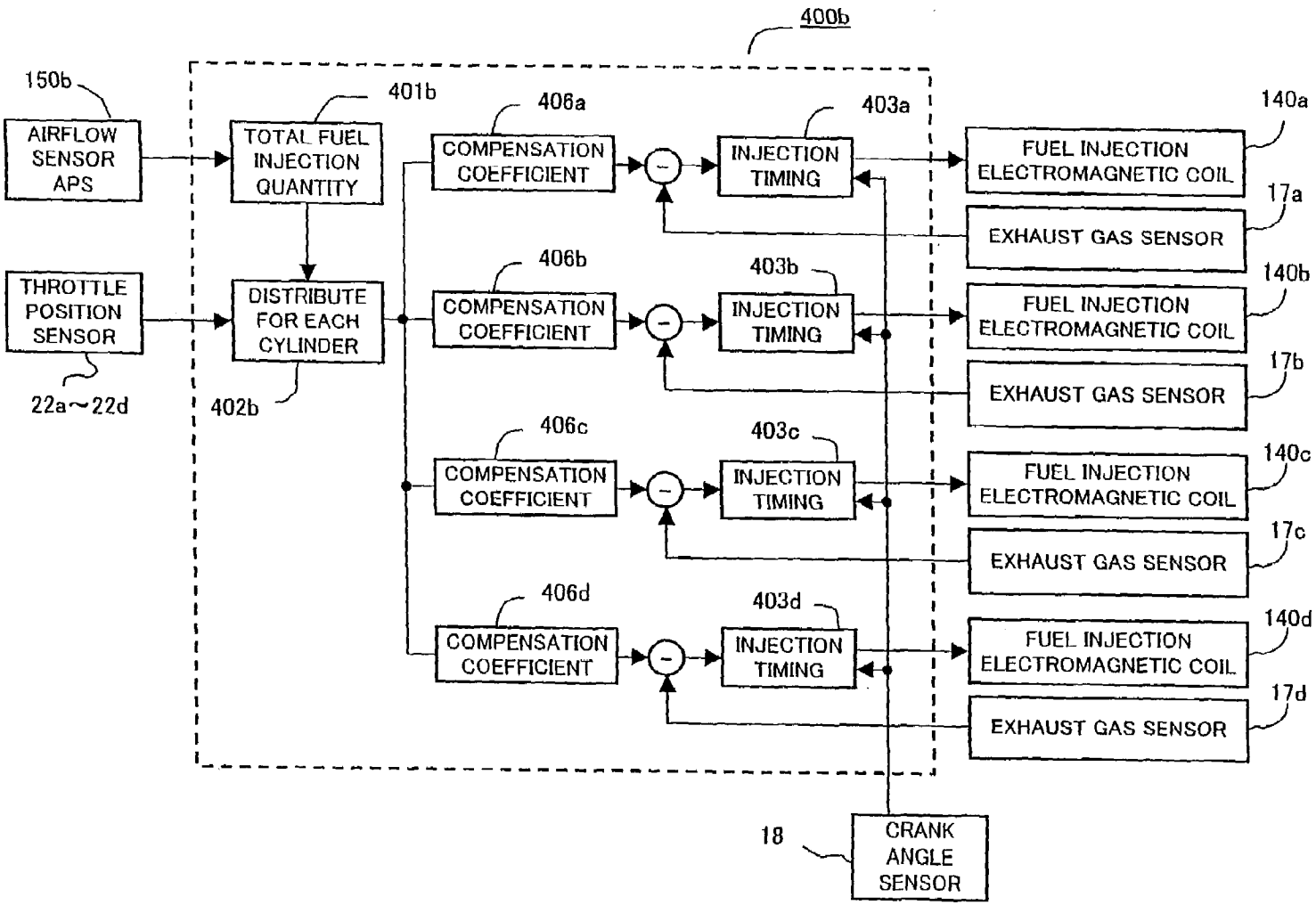
FIG. 7 is a block diagram of fuel injection control means of the operation control device shown in FIG. 6.

FIG. 7 is a block diagram of the fuel injection control means shown in FIG. 6. Referring to FIG. 7, control signals such as those of the airflow sensor 150*b*, exhaust gas sensors 17*a* to 17*d*, the throttle position sensors 22*a* to 22*d*, and the crank angle sensor 18 to fuel injection control means 400*b* with respect to the electromagnetic coils 140*a* to 140*d* of the fuel injecting solenoid valves 14*a* to 14*d*.

Total fuel feed setting means 401*b* is means that determines a total fuel feed quantity capable of obtaining a predetermined air/fuel ratio in accordance with a total air-intake having been detected by the airflow sensor 150*b*. Individual cylinder fuel injection distributing means 402*b* is means that distributes the above-mentioned total fuel feed quantity into individual cylinder fuel injection quantities in accordance with a detection output from the throttle position sensors 22*a* to 22*d* of the individual cylinders.

Individual cylinder fuel injection timing adjustment means 430*a* to 403*d* control a drive start timing and drive period of the fuel injecting solenoid valves 14*a* to 14*d* of each cylinder, and the foregoing drive period is determined based on a distribution amount of the above-mentioned individual cylinder fuel injection. Further, individual cylinder fuel injection compensation means 406*a* to 406*d* is means that compensates a coefficient of proportionality between an individual cylinder fuel injection quantity distributed by the mentioned individual cylinder fuel injection distributing means 402*b* and a drive period of the fuel injecting solenoid valves 14*a* to 14*d* determined by individual cylinder fuel injection timing adjustment means 403*a* to 403*d*. By this individual cylinder fuel injection compensation means 406*a* to 406*d*, a predetermined coefficient of proportionality common to each cylinder is used at the start of operation of a multi-cylinder engine and a ratio between a drive period of the fuel injecting solenoid valves 14*a* to 14*d* and an individual cylinder fuel injection quantity that is adjusted in response to a detection output from the exhaust gas sensors 17*a* to 17*d* mounted on the individual cylinder exhaust pipes 16*a* to 16*d* is learned and stored to be saved in a data memory during the operation of the multi-cylinder engine. At the next operation, a relation between an individual cylinder fuel injection quantity and a drive period of the fuel injecting solenoid valves 14*a* to 14*d* is determined based on the foregoing value having been learned and stored.

As obvious from the above descriptions, an operation control device according to this second embodiment of the invention is an operation control device 30*b* of a multi-cylinder engine 10 including electronic throttle control means, fuel injection control means, and air/fuel ratio control means. In this operation control device of a multi-cylinder engine, the mentioned electronic throttle control means includes motors 20*a* to 20*d* for controlling a throttle valve opening that are provided respectively at individual cylinder intake pipes 15*a* to 15*d*, and a drive control circuit feeding an electric power to the mentioned motor includes switching elements 34*a* to 34*d* of which ON/OFF is controlled by a microprocessor 31 containing a program memory 32*b* and a data memory 33.

The mentioned program memory 32*b* further contains a program acting as total fuel feed setting means 401*b*, individual cylinder fuel injection distributing means 402*b*, and fuel injection timing adjustment means 403*a* 403*d*. The mentioned total fuel feed setting means 401*b* is means that sets a total fuel feed quantity with respect to all cylinders in proportion to a detection output from the airflow sensor 150*b* provided at mentioned intake manifold 150*a*. The mentioned individual cylinder fuel injection distributing means 402*b* is means that distributes the mentioned total fuel feed quantity into individual cylinder fuel injection quantities depending on the mentioned detection output from the throttle position sensor 22*a* to 22*d* of the individual cylinders.

Furthermore, the mentioned fuel injection timing adjustment means 403*a* to 403*d* is means that control a drive start timing and drive period of fuel injection solenoid valves 14*a* to 14*d* for each cylinder. The mentioned drive period is determined as a reference value based on a distribution amount of the mentioned individual cylinder fuel injection. The mentioned fuel injection timing adjustment means 403*a* to 403*d* is means that adjusts a drive period of fuel injection solenoid valves 14*a* to 14*d* for each cylinder in accordance with a detection output from the exhaust gas sensors 17*a* to 17*d* provided at the individual cylinder exhaust pipes 16*a* 16*d*.

As a result, a feature exits in that even if a throttle valve opening of each cylinder is different, or fluctuation or variation in fuel injection control characteristic of each cylinder is present, an air/fuel ratio of each cylinder can be controlled with accuracy with the use of the exhaust gas sensors 17*a* to 17*d* provided at the individual cylinder exhaust pipes 16*a* to 16*d*.

While the presently detailed embodiments of the present invention have been shown and described. It is to be understood that these disclosures are for the purpose of illustration and that various changes and modifications may be made without departing from the scope of the invention as set forth in the appended claims.

What is claimed is:

1. An operation control device of a multi-cylinder engine comprising electronic throttle control means, fuel injection control means, and air/fuel ratio control means;

wherein said electronic throttle control means includes motors each provided at an individual cylinder intake pipe to control a throttle valve opening, and a drive control circuit feeding an electric power to said motor includes a switching element of which ON/OFF is controlled by a microprocessor having a program memory and a data memory;

said data memory contains a corrective characteristic parameter, and said program memory contains a program acting as means for setting a target throttle valve opening that can be obtained by adding a characteristic correction value or multiplying a characteristic correction coefficient with reference to a detection output from an accelerator position sensor detecting a depression degree of an accelerator pedal, and a program acting as motor control means;

said corrective characteristic parameter is a statistical data that can be obtained by actually measuring preliminarily a relation between throttle valve openings of individual cylinders with which each individual cylinder air-intake becomes uniform in accordance with a detection output from an airflow sensor that is provided at an intake manifold located in upstream position of said individual cylinder intake pipe and an engine speed, and said corrective characteristic parameter acts as a characteristic parameter to compensate fluctuation in air intake resistance of an intake pipe;

said characteristic correction value or characteristic correction coefficient is an addition/subtraction constant or a multiplication coefficient correcting a target throttle valve opening individually for each cylinder so as to control a throttle valve opening of each individual cylinder based on said corrective characteristic parameter;

said motor control means is means for controlling ON/OFF of said switching element individually to cylinders so that a detection output from a throttle position sensor for each individual cylinder that detects a throttle valve opening becomes equal to said target throttle valve opening having been corrected individually for each cylinder; and a throttle valve opening of an individual cylinder intake pipe is electrically controlled in response to a depression degree of the accelerator pedal, and fuel injection is performed individually for each cylinder so as to be capable of obtaining a predetermined air/fuel ratio.

2. The operation control device of a multi-cylinder engine according to claim 1, wherein said program memory further contains a program acting as means for setting a target throttle valve opening that can be obtained by adding an idle rotation compensation output taking said detection output from the accelerator position sensor as a reference; and said idle rotation compensation output operates in an idle rotation state that an accelerator pedal is not depressed, and is a compensation output that increases or decreases in accordance with a deviation between a steady minimum engine speed relevant to a coolant temperature of an engine and a current engine speed.

3. An operation control device of a multi-cylinder engine comprising, electronic throttle control means, fuel injection control means, and air/fuel ratio control means;

wherein said electronic throttle control means includes motors each provided at an individual cylinder intake pipe to control a throttle valve opening, and a drive control circuit feeding an electric power to said motor includes a switching element of which ON/OFF is controlled by a microprocessor having a program memory and a data memory;

said program memory further contains a program acting as means for setting a target throttle valve opening that can be obtained by adding an acceleration/deceleration compensation output taking a detection output from an accelerator position sensor detecting a depression degree of an accelerator pedal as a reference, and a program acting as motor control means;

said acceleration/deceleration compensation output is a compensation output that transiently makes a throttle valve opening of a cylinder having a high response characteristic smaller than a cylinder having a low response characteristic, or causes a throttle valve opening of a cylinder having a high response characteristic to reach in a delayed manner said reference value corresponding to said detection output from the accelerator position sensor based on a desired acceleration/deceleration detected with a differential value of said detection outputs from the accelerator position sensor and a difference in transient response characteristic of each individual cylinder intake pipe;

said motor control means is means for performing an ON/OFF control of said switching element individually for each cylinder so that a detection output from a throttle position sensor of the individual cylinders that detect a throttle valve opening becomes equal to said target throttle valve opening having been compensated; and a throttle valve opening of the individual cylinder intake pipe is electrically controlled in response to a depression degree of the accelerator pedal, and fuel injection is performed individually for each cylinder so as to be capable of obtaining a predetermined air/fuel ratio.

4. The operation control device of a multi-cylinder engine according to claim 3, wherein said program memory further contains a program acting as means for setting a target throttle valve opening that can be obtained by adding an inertia compensation output taking said detection output from the accelerator position sensor as a reference; and said inertia compensation output is a compensation output that increases or decreases in common a target throttle valve opening of each cylinder in response to a desired acceleration/deceleration detected with a differential value of said detection output from the accelerator position sensor.

5. An operation control device of a multi-cylinder engine comprising electronic throttle control means, fuel injection control means, and air/fuel ratio control means;

wherein said electronic throttle control means includes motors each provided at an individual cylinder intake pipe to control a throttle valve opening, and a drive control circuit feeding an electric power to said motor includes a switching element of which ON/OFF is controlled by a microprocessor having a program memory and a data memory;

said program memory further contains a program acting as means, for setting a target throttle valve opening that can be obtained taking a detection output from an accelerator position sensor detecting a depression degree of an accelerator pedal as a reference, a program acting as motor control means, and a program acting as sequential compensation means;

said sequential compensation means is means that operates when said target throttle valve opening changes, and causes a target throttle valve opening with respect to a throttle valve of a cylinder at which an air intake process starts to sequentially change;

said motor control means is means for controlling ON/OFF of said switching element individually for each cylinder so that a detection output from a throttle position sensor of the individual cylinders detecting a throttle valve opening comes to be equal to said target throttle valve opening;

said data memory further contains a valve-opening characteristic parameter; and said program memory further contains a program acting as means for setting a target throttle valve opening that can be obtained by adding a characteristic compensation value or multiplying a characteristic compensation coefficient taking a detection output from the accelerator position sensor detecting a depression degree of an accelerator pedal as a reference, and a program acting as motor control means;

said valve-opening characteristic parameter is a statistical data determining a characteristic of an appropriate throttle valve opening of individual cylinders having been actually measured preliminarily in order to obtain an efficient engine output as a whole in accordance with a depression degree of the accelerator pedal and an engine speed;

said characteristic compensation value or characteristic compensation coefficient is an addition-subtraction constant or a multiplication coefficient correcting a target throttle valve opening individually for each cylinder so as to control a throttle valve opening of each individual cylinder based on said valve-opening characteristic parameter; and a throttle valve opening of an individual cylinder intake pipe is electrically controlled depending on a depression degree of an accelerator pedal, and fuel injection is carried out individually for each cylinder so as to be capable of obtaining a predetermined air/fuel ratio.

6. An operation control device of a multi-cylinder engine comprising electronic throttle control means, fuel injection control means, and air/fuel ratio control means;

wherein said electronic throttle control means includes motors each provided at an individual cylinder intake pipe to control a throttle valve opening, and a drive control circuit feeding an electric power to said motor includes a switching element of which ON/OFF is controlled by a microprocessor having a program memory and a data memory;

said data memory further contains a valve-opening characteristic parameter; and said program memory further contains a program acting as means for setting a target throttle valve opening that can be obtained by adding a characteristic compensation value or multiplying a characteristic compensation coefficient taking a detection output from the accelerator position sensor detecting a depression degree of an accelerator pedal as a reference, and a program acting as motor control means;

said valve-opening characteristic parameter is a statistical data determining a characteristic of an appropriate throttle valve opening of individual cylinders having been actually measured preliminarily in order to obtain an efficient engine output as a whole in accordance with a depression degree of the accelerator pedal and an engine speed;

said characteristic compensation value or characteristic compensation coefficient is an addition-subtraction constant or a multiplication coefficient correcting a target throttle valve opening individually for each cylinder so as to control a throttle valve opening of each individual cylinder based on said valve-opening characteristic parameter;

said motor control means is means for controlling ON/OFF of said switching element individually for each cylinder so that a detection output from a throttle position sensor of the individual cylinders detecting a throttle valve opening comes to be equal to said target throttle valve opening of each individual cylinder; and a throttle valve opening of an individual cylinder intake pipe is electrically controlled depending on a depression degree of the accelerator pedal, and fuel injection is carried out individually for each cylinder so as to be capable of obtaining a predetermined air/fuel ratio.

7. The operation control device of a multi-cylinder engine according to claim 6, wherein said valve-opening characteristic parameter is determined such that operation is carried out in a full-throttle state with a throttle valve of all cylinders full open under the state that the accelerator pedal is fully depressed; the operation is carried out with the cylinders divided into a first cylinder group of which throttle valve opening becomes a little larger than a standard value and a second cylinder group of which throttle valve opening becomes a little smaller under the state that the accelerator pedal is depressed halfway; the fuel injection relative to said first cylinder group and the fuel injection relative to said second cylinder group are performed alternately; and an increase/decrease deviation from said standard value is suppressed within a range where a car body vibration does not become actual.

8. The operation control device of a multi-cylinder engine according to claim 1, 3, 5 or 6, wherein a mechanism section of said electronic throttle control means comprises an initial position return mechanism; and said data memory further contains an evacuation characteristic parameter, and said program memory further contains a program acting as error processing means and evacuation operation switching means;

said initial position return mechanism is a mechanism operating upon interruption of a current to said motor to return and set a throttle valve opening of each individual cylinder intake pipe to a fixed position;

said error processing means is means that operates when detecting a disconnection and short circuit at a motor power feed circuit and a disconnection and short circuit at a detection circuit of a throttle position sensor, and interrupting a power supply of a switching element of a motor mounted on a cylinder where error occurs;

said evacuation characteristic parameter is a statistical data that can be obtained by actually measuring preliminarily a relation between appropriate throttle valve openings of the remaining normal cylinders, in accordance with the number of cylinders in the fixed throttle valve opening state, a depression degree of the accelerator pedal, and an engine speed; and said evacuation operation switching means is means that performs selection and switching so as to control a throttle valve opening of a normal cylinder based on said evacuation characteristic parameter in a non-control state that said error processing means operates, and a throttle valve opening of a part of cylinders are initialized by said initial position return means.

9. The operation control device of a multi-cylinder engine according to claim 1, 3, 5, or 6, wherein said program memory further contains a program acting as total air/fuel ratio adjustment means, individual cylinder fuel injection distributing means, and fuel injection timing control means;

said total air/fuel ratio adjustment means is means that adjusts a total fuel feed quantity to all cylinders so as to get a predetermined air/fuel ratio in accordance with a detection output from an airflow sensor provided at said intake manifold and a detection output from an exhaust gas sensor provided at an exhaust manifold;

said individual cylinder fuel injection distributing means is means that distributes said total fuel feed quantity into individual cylinder fuel injection quantities depending on said detection output from the throttle position sensor of the individual cylinders; and said fuel injection timing control means is means that controls a drive start timing and a drive period of a fuel injection solenoid valve of each cylinder, said drive period being determined based on a distribution quantity of said individual cylinder fuel injection.

10. The operation control device of a multi-cylinder engine according to claim 1, 3, 5, or 6, wherein said program memory further contains a program acting as total fuel feed setting means, individual cylinder fuel injection distributing means, and fuel injection timing adjustment means;

said total fuel feed setting means is means that sets a total fuel feed quantity to all cylinders in proportion to a detection output from the airflow sensor provided at said intake manifold;

said individual cylinder fuel injection distributing means is means that distributes said total fuel feed quantity into individual cylinder fuel injection quantities depending on said detection output from the throttle position sensor of the individual cylinders; and said fuel injection timing adjustment means is means that controls a drive start timing and drive period of a fuel injection solenoid valve of each cylinder, said drive period being determined as a reference value based on a distribution amount of said individual cylinder fuel injection, and adjusts a drive period of a fuel injection solenoid valve of each cylinder in accordance with a detection output from the exhaust gas sensor provided at the individual cylinder exhaust pipe.

* * * * *